US005823399A

United States Patent [19]

Gartner

[11] Patent Number: 5,823,399

[45] Date of Patent: Oct. 20, 1998

[54] CONTAINER ADAPTED FOR SPRAYING

[76] Inventor: Peter Gartner, Kirchgassweg 13, D-77815 Bühl, Germany

[21] Appl. No.: 700,968

[22] Filed: Aug. 21, 1996

[30] Foreign Application Priority Data

Aug. 26, 1995 [DE] Germany ..... 295 13 716.9

[51] Int. Cl.[6] ..... B65D 83/14

[52] U.S. Cl. ..... 222/209; 222/401

[58] Field of Search ..... 222/209, 401

[56] References Cited

U.S. PATENT DOCUMENTS 4,341,330 7/1982 Mascia et al. ..... 222/401

FOREIGN PATENT DOCUMENTS 0 484 574 A1 7/1990 European Pat. Off. ..... 222/401
0 484 574 A1 11/1990 European Pat. Off. .

*Primary Examiner*—Andres Kashnikow
*Assistant Examiner*—David Deal
*Attorney, Agent, or Firm*—Collard & Roe, P.C.

[57] ABSTRACT

The invention relates to a container such as a bottle or can made from sheet metal, plastic or any desired material, which is adapted for spraying. The container has a spray valve disposed on the top side, and a pumping attached to the bottom side of the container for generating excess air pressure in the container. The pumping device is connected with the interior space of the container via a first valve. The pumping device consists of two bellows tightly connected to the bottom side of the container and concentrically placed one inside the other. The inner bellows is tightly inserted in the outer bellows, which is designed as a bottom cap. A second valve is inserted in a bottom opening of the inner bellows. The container functions in such a way that lifting the container allows air to enter the inner bellows via the second valve. The second valve is configured so that air is not permitted to escape out of the inner bellows through the valve. Depressing the container against a support forces the air in the inner bellows through the first valve and into the interior space of the container.

2 Claims, 1 Drawing Sheet

CONTAINER ADAPTED FOR SPRAYING

BACKGROUND OF THE INVENTION

1. Field of the Invention

The invention relates to a container such as a bottle or can made from sheet metal, plastic or any desired material, which is adapted for spraying. The container is fitted with a spray valve on the top side, and a pumping device on the bottom side. The pumping device is capable of generating excess air pressure in the interior space of the container and is connected to the interior space of the container via a valve.

2. The Prior Art

European Patent Application 0 484 574 A1 describes such a container in which the pumping device consists of a bellows which is tightly connected to the bottom side of the container. The bellows has an opening on the bottom side and encloses a space. The space can be reduced by pressing the container down onto a support, and can be enlarged by lifting the container. The container has at least one valve arranged on the bottom side or in the interior space of the container. This valve is capable of allowing air into the interior space of the container.

In one embodiment of the prior art container, the pumping device consists of two bellows. The bellows reduce the space and are placed concentrically one inside the other. Only one valve is used in this embodiment and is located on the bottom of the container and attached to the inner bellows. This prior art container has at least one drawback: due to the open lower space in the bellows, it is very difficult to generate, by depressing and lifting the container, enough pressure to be able to spray.

SUMMARY OF THE INVENTION

It is therefore an object of the present invention to overcome the disadvantages of the prior art and to create a container adapted for spraying in which air can be easily pressed into the container in a simple way by lifting and pressing the container down onto a support.

The above and other objects of the present invention are accomplished according to the present invention by a container of the two bellows-type specified above having a spray valve disposed on the top side, wherein the inner bellows is tightly and concentrically placed in the outer bellows, the outer bellows functioning as a bottom cap, and wherein a first valve is arranged in the bottom opening of the container and a second valve is inserted in the bottom opening of the inner bellows. The second valve is adapted to let air into but not out of the inner bellows.

According to a preferred embodiment, the inner bellows is placed over a short attachment tube inserted into the bottom opening of the container, to which tube the first valve is attached. The first valve is then connected to a rising tube which extends into the interior space of the container.

The container according to the present invention has the significant advantage that when it is pressed down against a support, the air in the space of the inner bellows is forced into the interior space of the container via the first valve. As the container is being lifted, the inner bellows is filled with air via the second valve. When the container is then pressed down again against the support, the air remaining in the inner bellows is forced again into the container through the first valve and cannot escape on the bottom side of the inner bellows through the second valve.

BRIEF DESCRIPTION OF THE DRAWINGS

Other objects and features of the present invention will become apparent from the following detailed description considered in connection with the accompanying drawing. It is to be understood, however, that the drawing is designed as an illustration only and not as a definition of the limits of the invention.

In the drawing.

DETAILED DESCRIPTION OF THE PREFERRED EMBODIMENT

Figure 1:
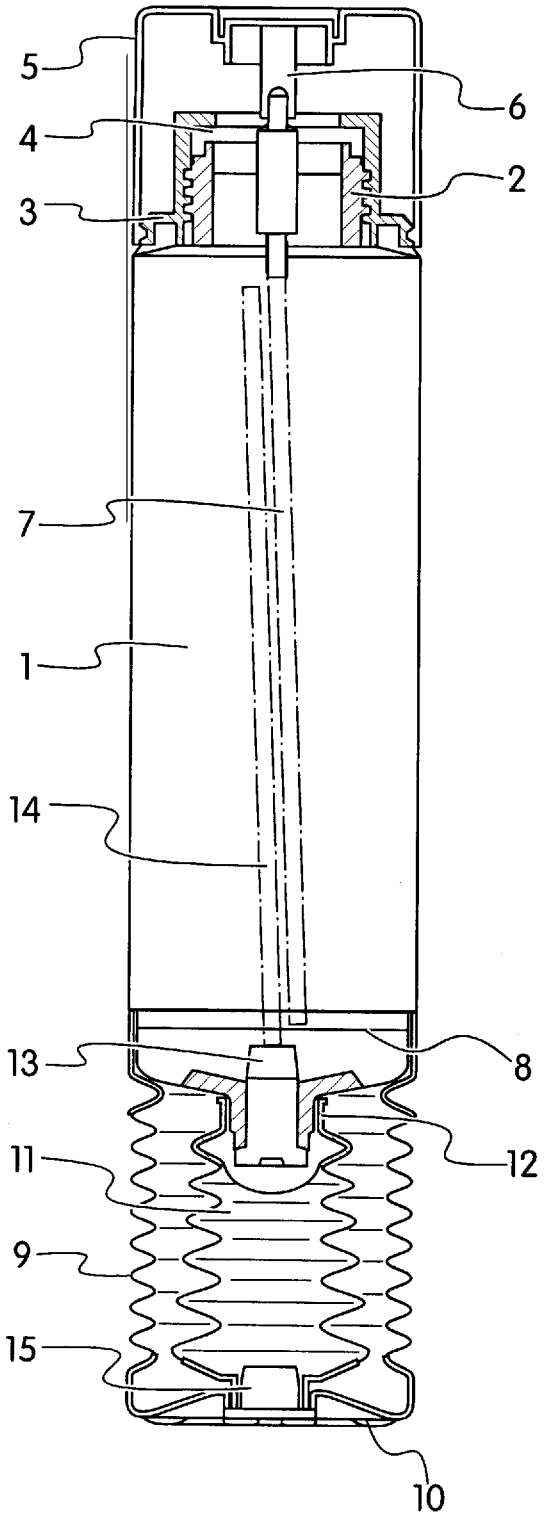
FIG. 1 is a longitudinal sectional view of a cylinder-shaped container according to the invention.

Referring now in detail to FIG. 1, the container is comprised of a pressure container 1 having on the top side a short threaded pipe 2, onto which a cap 3 may be screwed, such cap containing spray valve 4. The top side of the container is sealed with spray cap 5, which has an actuating lever 6 for spray valve 4. Spray valve 4 has on the bottom side a rising tube 7 for the liquid, such tube almost reaching to the bottom of container 1.

Container 1 has a groove 8 extending all around the bottom side. A bellows designed as a bottom cap 9 and having openings for the exit of air is placed over the groove. Bottom cap 9 is sealed on the bottom side as shown at 10 and has a center opening, in which an inner bellows 11 designed as a pump body is inserted. The top side of inner bellows 11 is placed over a short attachment tube 12, in which first valve 13 is inserted. Valve 13 is connected to rising tube 14 for the passage of air into the interior of the container.

A second valve 15 is inserted in the bottom opening of inner bellows 11, the valve allowing the air from the outside only into and not out of inner bellows 11. Therefore, pressing the container down a number of times against the support has the effect of forcing the air present in inner bellows 11 into the interior space of container 1 through valve 13 and rising tube 14.

Accordingly, while only one embodiment of the present invention has been shown and described, it is obvious that many changes and modifications may be made thereunto without departing from the spirit and scope of the invention.

What is claimed is:

1. A container adapted for spraying having a top side, a bottom side, a bottom opening and an interior space and comprising:

a spray valve disposed on the top side;

a pumping device capable of generating excess air pressure in the container disposed on the bottom side of said container, said pumping device comprising an inner bellows and an outer bellows, the inner bellows having a bottom opening and being concentrically and tightly arranged inside the outer bellows, and wherein said outer bellows functions as a bottom cap;

a first valve arranged in the bottom opening of the container, said first valve capable of allowing air from the pumping device into the interior space of the container;

a second valve disposed in the bottom opening of the inner bellows, said second valve capable of allowing air only into and not out of the inner bellows;

a short attachment tube inserted into the bottom opening of the container and attached to the first valve, wherein the inner bellows is placed over the attachment tube; and a rising tube having two ends, the first end being connected to the first valve and the second end extending into the interior space of the container, such that lifting the container allows air to enter the inner bellows through the second valve, and pressing the container down against a support forces air from the inner bellows through the first valve into the interior space of the container.

2. Container according to claim 1, wherein the container is made from a material selected from the group comprising sheet metal and plastic.

* * * * *